US009844278B2

(12) United States Patent
Winterhalter

(10) Patent No.: US 9,844,278 B2
(45) Date of Patent: Dec. 19, 2017

(54) JOINT MECHANISM AND CHILD HIGH CHAIR THEREOF

(71) Applicant: Andrew J. Winterhalter, West Lawn, PA (US)

(72) Inventor: Andrew J. Winterhalter, West Lawn, PA (US)

(73) Assignee: Wonderland Switzerland AG, Steinhausen (CH)

( * ) Notice: Subject to any disclaimer, the term of this patent is extended or adjusted under 35 U.S.C. 154(b) by 338 days.

(21) Appl. No.: 14/681,117

(22) Filed: Apr. 8, 2015

(65) Prior Publication Data

US 2015/0289674 A1 Oct. 15, 2015

Related U.S. Application Data

(60) Provisional application No. 61/995,478, filed on Apr. 11, 2014.

(51) Int. Cl.
*A47D 1/00* (2006.01)
*A47D 1/02* (2006.01)

(52) U.S. Cl.
CPC ..... *A47D 1/02* (2013.01); *A47D 1/002* (2013.01); *A47D 1/008* (2013.01); *A47D 1/0083* (2017.05)

(58) Field of Classification Search
CPC ..... A47D 1/002; A47D 1/008; A47D 1/02; A47D 1/0081; A47D 1/0083; A47C 4/10; A47C 4/20; B62B 7/06; B62B 7/066
USPC ..... 280/47.38
See application file for complete search history.

(56) References Cited

U.S. PATENT DOCUMENTS 6,692,070 B1 2/2004 Hou
7,798,500 B2 * 9/2010 Den Boer ..... B62B 7/062 280/47.34
9,404,528 B2 * 8/2016 Shan
2005/0110320 A1 * 5/2005 Wang ..... A47D 1/002 297/344.14
2005/0242646 A1 * 11/2005 You ..... A47D 1/02 297/354.1
2008/0290699 A1 * 11/2008 Golias ..... A47D 1/002 297/16.1

(Continued)

FOREIGN PATENT DOCUMENTS

CN 101785618 A 7/2010
CN 102342690 A 2/2012

(Continued)

*Primary Examiner* — Ryan D Kwiecinski
(74) *Attorney, Agent, or Firm* — Winston Hsu

(57) ABSTRACT

A joint mechanism of a child high chair includes a first leg, a second leg, an extension arm and a latching component. The first leg includes a cammed portion and an accommodating space. The second leg is pivotally connected to the first leg to switch between a folded position and an unfolded position. The extension arm which includes a restricted portion is pivotally connected to the second leg. The latching component includes a main body disposed on the second leg, and a protrusion disposed on a part of the main body opposite to the second leg. The protrusion is located inside the accommodating space to contact against the restricted portion while the second leg is switched to the unfolded position, and the protrusion is moved upon the cammed portion to separate from the restricted portion while the second leg is switched to the folded position.

20 Claims, 9 Drawing Sheets

(56) References Cited

U.S. PATENT DOCUMENTS

| | | | | |
|---|---|---|---|---|
| 2013/0140797 | A1* | 6/2013 | Fritz | B62B 7/08 280/649 |
| 2013/0207369 | A1* | 8/2013 | Pollack | B62B 9/12 280/650 |
| 2013/0257019 | A1* | 10/2013 | Eisinger | B62B 7/06 280/650 |
| 2015/0151774 | A1* | 6/2015 | Liu | B62B 7/08 403/103 |

FOREIGN PATENT DOCUMENTS

| | | | | |
|---|---|---|---|---|
| CN | 103359142 | A | 10/2013 | |
| CN | 203354116 | U | 12/2013 | |
| DE | 2349264 | A1 * | 4/1975 | A47C 4/04 |
| DE | WO-2008028598 | A1 * | 3/2008 | A47D 1/002 |
| GB | WO-2011161392 | A1 * | 12/2011 | A47D 1/008 |
| WO | 2011161392 | A1 | 12/2011 | |

* cited by examiner

JOINT MECHANISM AND CHILD HIGH CHAIR THEREOF

CROSS REFERENCE TO RELATED APPLICATIONS

This application claims the benefit of U.S. provisional application No. 61/995,478, filed on Apr. 11, 2014. The entire contents of these related applications are incorporated herein by reference.

BACKGROUND OF THE INVENTION

1. Field of the Invention

The present invention relates to a joint mechanism and a child high chair thereof, and more particularly, to a joint mechanism capable of automatically folding the tray while two legs are folded and a child high chair having the foresaid joint mechanism.

2. Description of the Prior Art

A conventional child high chair becomes a standard for safety, comfort and convenience when feeding a young child in household field. A seat height of the child high chair can be adjusted to be close to the caregiver in order to conveniently attend to the child. The conventional child high chair includes rollers disposed on a frame to easily move the child high chair. The conventional child high chair further includes a tray and a horn disposed on the seat. The horn is located between the child's legs and utilized to restrain a child for preventing the child from falling out, and the tray not only can be utilized to put the food, the toy and so on but also can offer a robust barrier to prevent the child from falling out. Stability of the child high chair is a primary factor in its overall safety, and the conventional child high chair has drawbacks of large size and bulkiness. The bulky child high chair is difficult to store, and is a real frustration to fold and to find a place to store when not in use. Therefore, designing a new child high chair capable of maintaining the current standard for safety and comfort and providing easy functions to fold and unfold is an important issue in the related mechanical design industry.

SUMMARY OF THE INVENTION

The present invention provides a joint mechanism capable of automatically folding the tray while two legs are folded and a child high chair having the foresaid joint mechanism for solving above drawbacks.

According to the claimed invention, a joint mechanism includes a first leg, a second leg, an extension arm and a latching component. The first leg includes a cammed portion and an accommodating space adjacent by each other. The second leg is pivotally connected to the first leg, and the second leg is rotated relative to the first leg to switch between a folded position and an unfolded position. The extension arm is pivotally connected to the second leg, and the extension arm includes a restricted portion. The latching component is movably disposed on the second leg. The latching component includes a main body and a protrusion. The main body is disposed on the second leg. The protrusion is disposed on a part of the main body opposite to the second leg. The protrusion is located inside the accommodating space to contact against the restricted portion while the second leg is switched to the unfolded position, and the protrusion is moved upon the cammed portion to separate from the restricted portion while the second leg is switched to the folded position.

According to the claimed invention, the main body is made of resilient material, and a resilient recovering force of the main body drives the protrusion to sink into the accommodating space while the protrusion moves from the cammed portion to the accommodating space. The main body includes a first part and a second part, an end of the first part is pivotally connected to the second leg, an end of the second part is connected to the end of the first part via a resilient component, and the protrusion is disposed on the other end of the second part. The resilient component is a torsional spring. The protrusion contacts against the restricted portion to constrain relative rotation between the extension arm and the second leg, and the extension arm is freely rotated relative to the second leg while the protrusion is separated from the restricted portion. The first leg further includes an arc-shaped structure and an extension structure, the accommodating space is an opening of the arc-shaped structure, the cammed portion is an outer surface of the arc-shaped structure, and the extension structure is connected to an end of the arc-shaped structure and stretches out into the opening. The second leg is folded relative to the first leg to slide the protrusion over the extension structure and the protrusion is moved from the extension structure to the cammed portion, the second leg is unfolded relative to the first leg to move the protrusion from the cammed portion into the accommodating space.

According to the claimed invention, a child high chair includes a seatback, a seat pan, a tray, two sets of leg tube and a joint mechanism. The seat pan is rotatably connected to the seatback. The joint mechanism includes a first leg, a second leg, an extension arm and a latching component. The first leg includes a cammed portion and an accommodating space adjacent by each other. The second leg is pivotally connected to the first leg, and the second leg is rotated relative to the first leg to switch between a folded position and an unfolded position. The extension arm is pivotally connected to the second leg, and the extension arm includes a restricted portion. The latching component is movably disposed on the second leg. The latching component includes a main body and a protrusion. The main body is disposed on the second leg. The protrusion is disposed on a part of the main body opposite to the second leg. The protrusion is located inside the accommodating space to contact against the restricted portion while the second leg is switched to the unfolded position, and the protrusion is moved upon the cammed portion to separate from the restricted portion while the second leg is switched to the folded position.

According to the claimed invention, an angle between the seatback and the seat pan is substantially equal to ninety degrees while the first leg and the second leg are unfolded, and the seat pan is substantially parallel to the seatback while the first leg and the second leg are folded. A protruding hole is formed on the seat pan, and the child high chair further includes a horn and a flexible connector, the horn is rotatably disposed on the seat pan and adjacent by the protruding hole, and two ends of the flexible connector are respectively connected to the seatback and the horn. A resilient recovering force of the flexible connector drives the horn to rotate relative to the seat pan and to protrude from an upper surface of the seat pan via the protruding hole. The tray presses the horn into the protruding hole or the horn is retracted into the protruding hole while the first leg and the second leg are folded. Further, the child high chair may include a torsional resilient unit disposed between the horn and the seat pan, and a resilient recovering force of the torsional resilient unit rotates the horn into the protruding hole.

The child high chair of the present invention can automatically retract the tray and the horn while folded. The second leg is folded relative to the first leg to rotate the latching component and to loosen the flexible connector, and the protrusion of the latching component can slide over the extension structure to move from the extension structure to the cammed portion, so the extension arm is not constrained by the protrusion and the tray can freely rotate relative to the second leg for retraction, and the horn can be pressed into the protruding hole by the tray, the gravity or the torsional resilient unit. In addition, the second leg is unfolded relative to the first leg to move the protrusion from the cammed portion to the accommodating space, the resilient recovering force of the main body or the resilient component drives the protrusion to sink into the accommodating space, and the flexible connector is lengthened to protrude the horn out of the protruding hole, so the protrusion can be utilized to constrain rotation of the extension arm when the tray is rotated to the useful position and the horn can prevent the child from sliding out of the seat pan. The child high chair can automatically retract the tray and the horn while being folded and further stabilize the tray and the horn at the useful position while unfolded. The child high chair of the present invention maintains current standards for safety and comfort, and also provides an easy to fold, compact storage solution that improves overall convenience.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
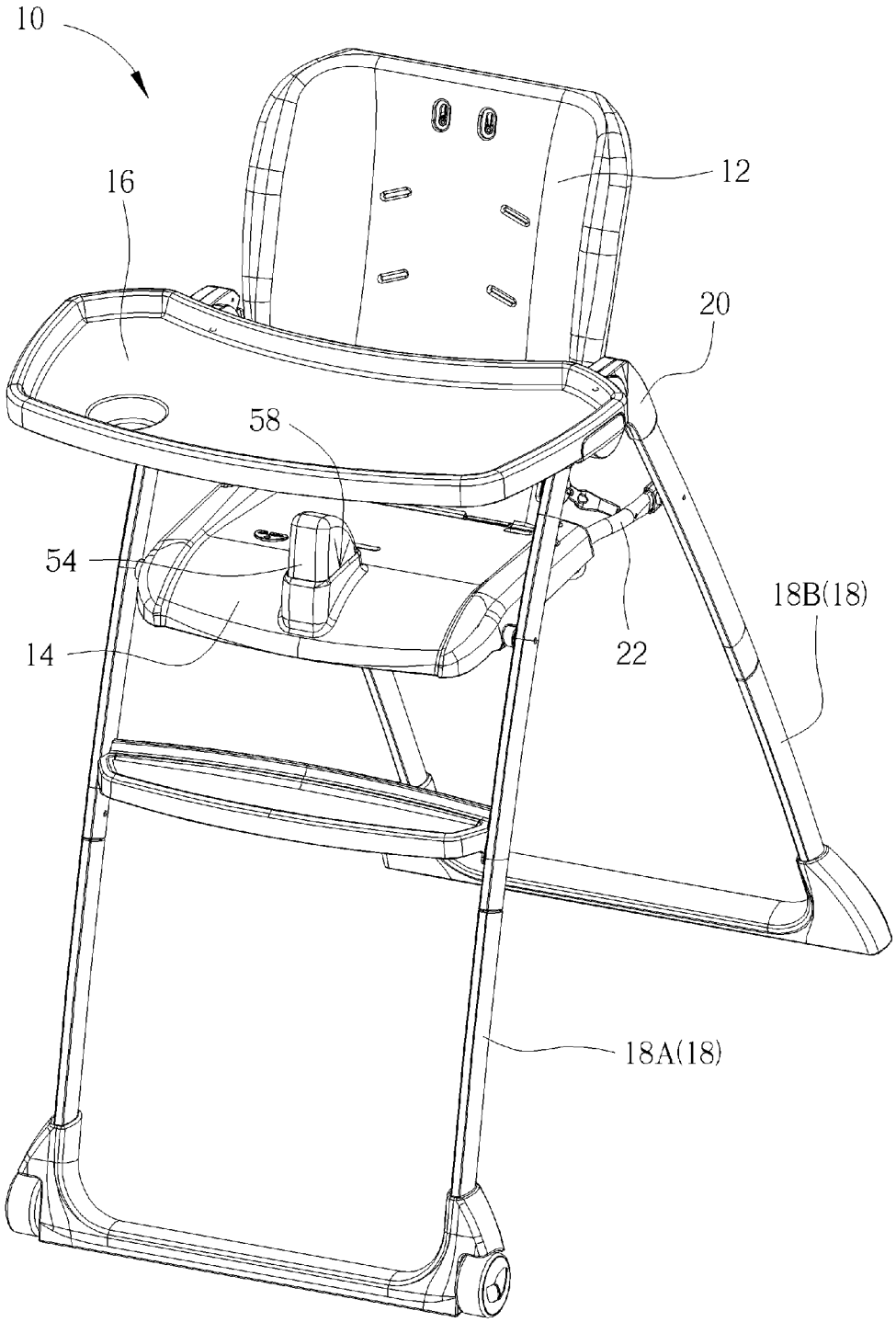
FIG. 1 is a diagram of a child high chair according to an embodiment of the present invention.
Figure 2:
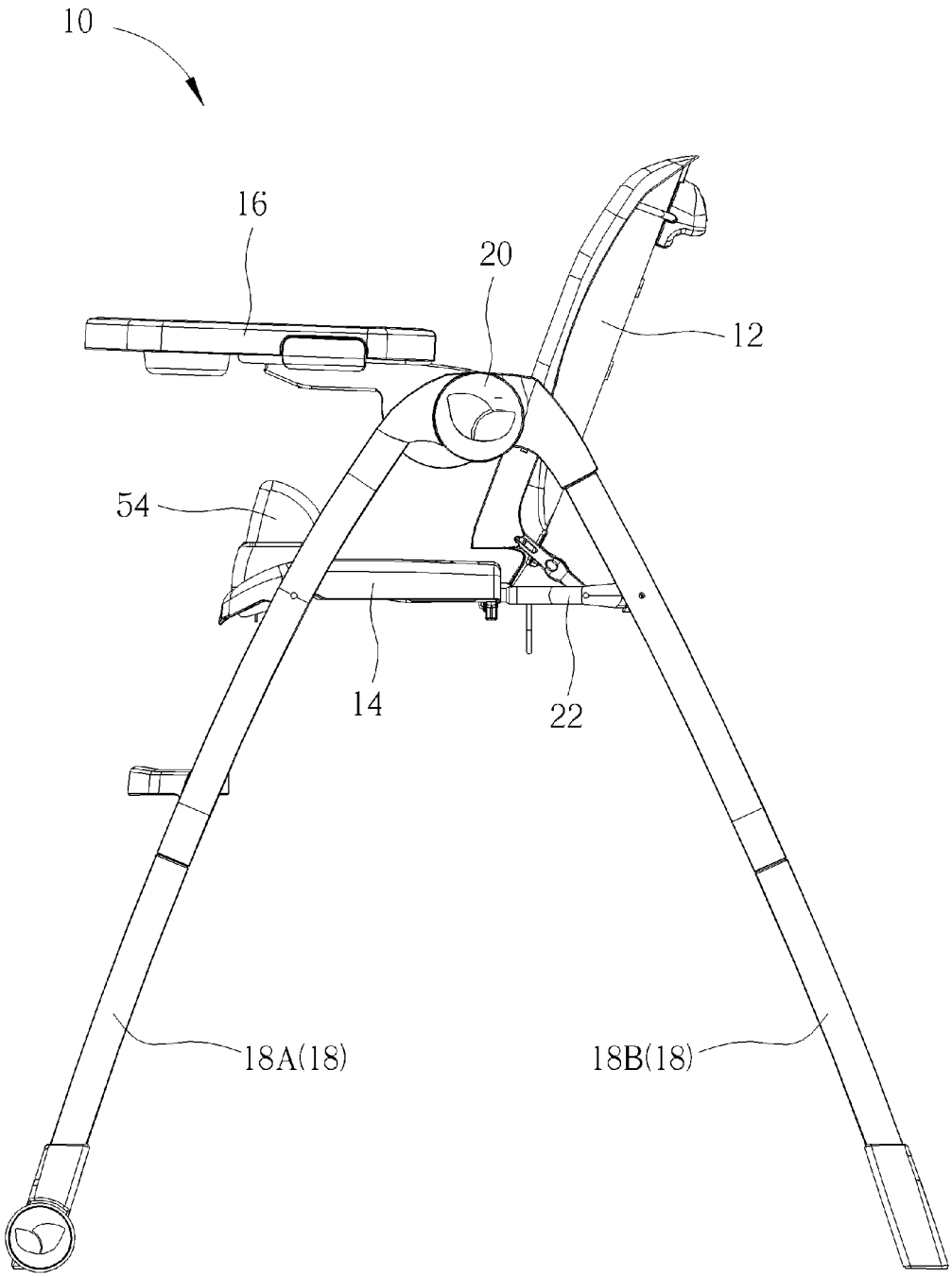
FIG. 2 and FIG. 3 respectively are lateral views of the child high chair in different operational modes according to the embodiment of the present invention.
Figure 3:
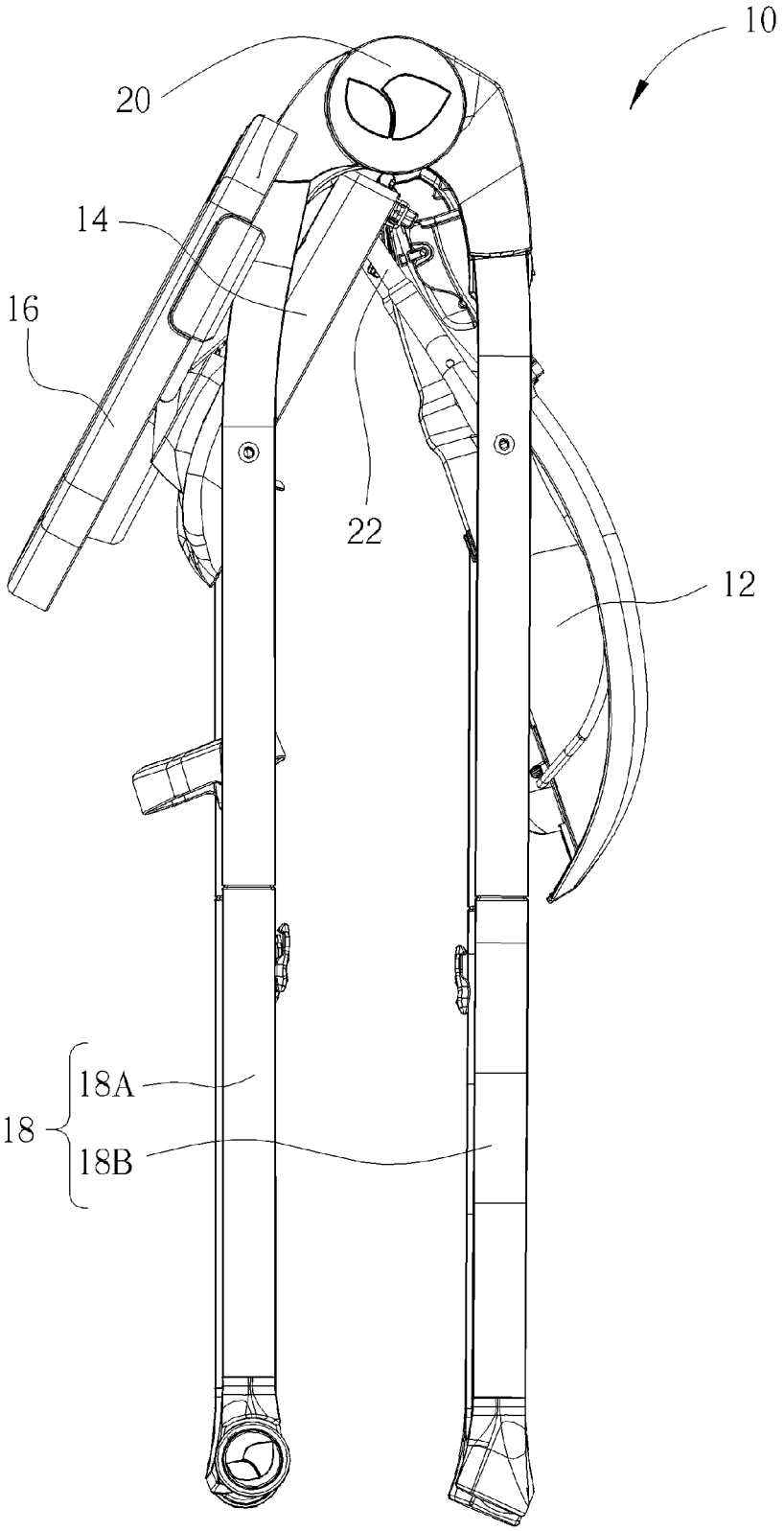

Please refer to FIG. 1 to FIG. 3. FIG. 1 is a diagram of a child high chair 10 according to an embodiment of the present invention. FIG. 2 and FIG. 3 respectively are lateral views of the child high chair 10 in different operational modes according to the embodiment of the present invention. The child high chair 10 includes a seatback 12, a seat pan 14, a tray 16, two sets of leg tube 18 and a joint mechanism 20. The two sets of leg tube 18 at least include a front leg tube 18A and a rear leg tube 18B. The seatback 12 can be rotatably connected to the joint mechanism 20 or the leg tubes 18. The seat pan 14 is rotatably connected to the seatback 12 and pivotally connected to the front leg tube 18A. Further, ends of a linkage module 22 are respectively pivotally connected to the seatback 12, the seat pan 14 and the rear leg tube 18B. The joint mechanism 20 is disposed between the two sets of leg tube 18, the tray 16 is connected to the joint mechanism 20 and an inclined angle of the tray 16 relative to the two sets of leg tube 18 can be controlled by the joint mechanism 20. While the child high chair 10 is unfolded shown in FIG. 1 and FIG. 2, the tray 16 stands and the child can stably sit on the child high chair 10 for meal. While the child high chair 10 is folded shown in FIG. 3, constraint of the tray 16 is liberated by the joint mechanism 20, the tray 16 drops down automatically due to rotation of the two sets of leg tube 18 to minimize size of the child high chair 10 for convenient storage.

Figure 4:
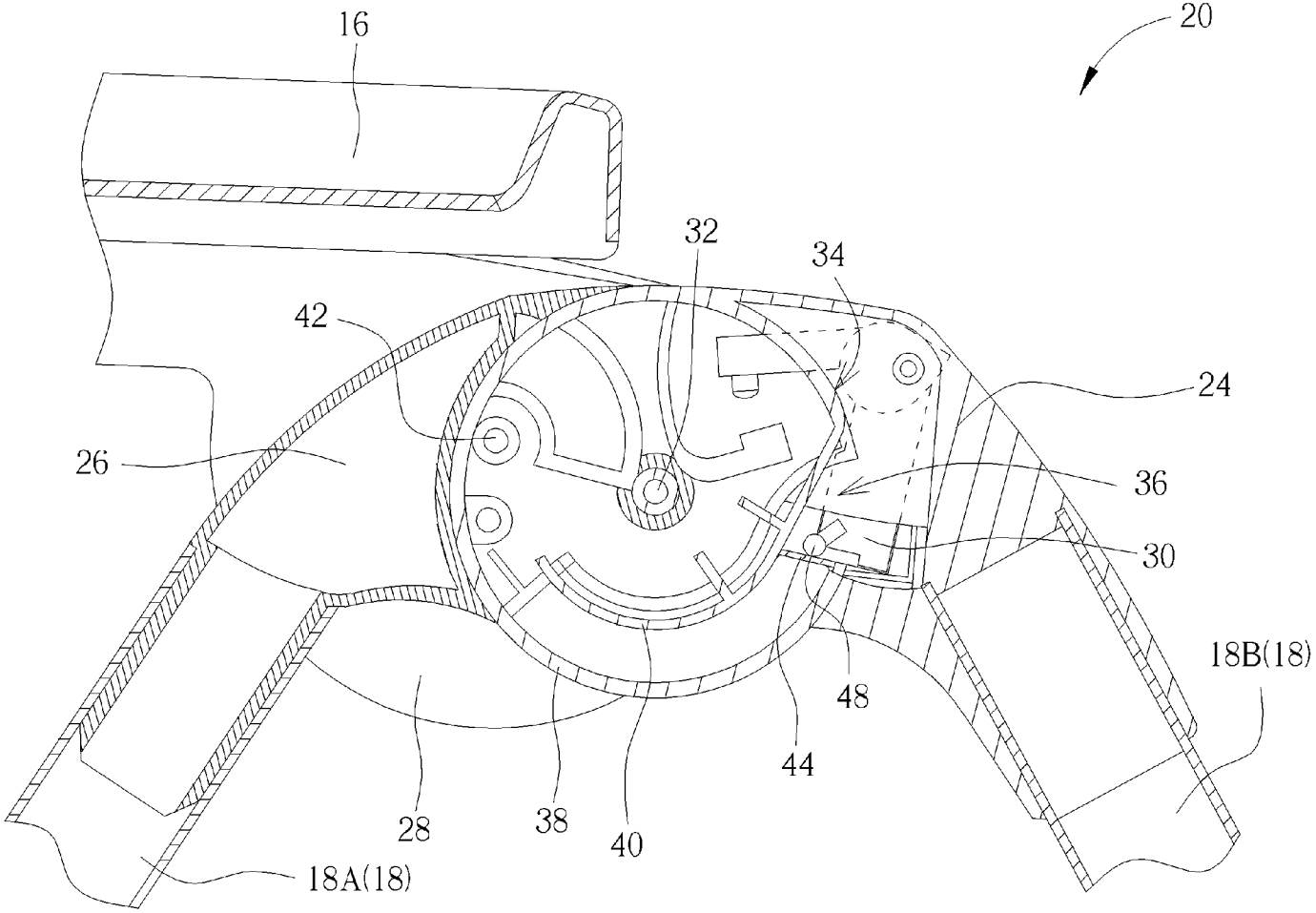
FIG. 4 to FIG. 6 respectively are sectional views of a joint mechanism indifferent operational modes according to the embodiment of the present invention.
Figure 5:
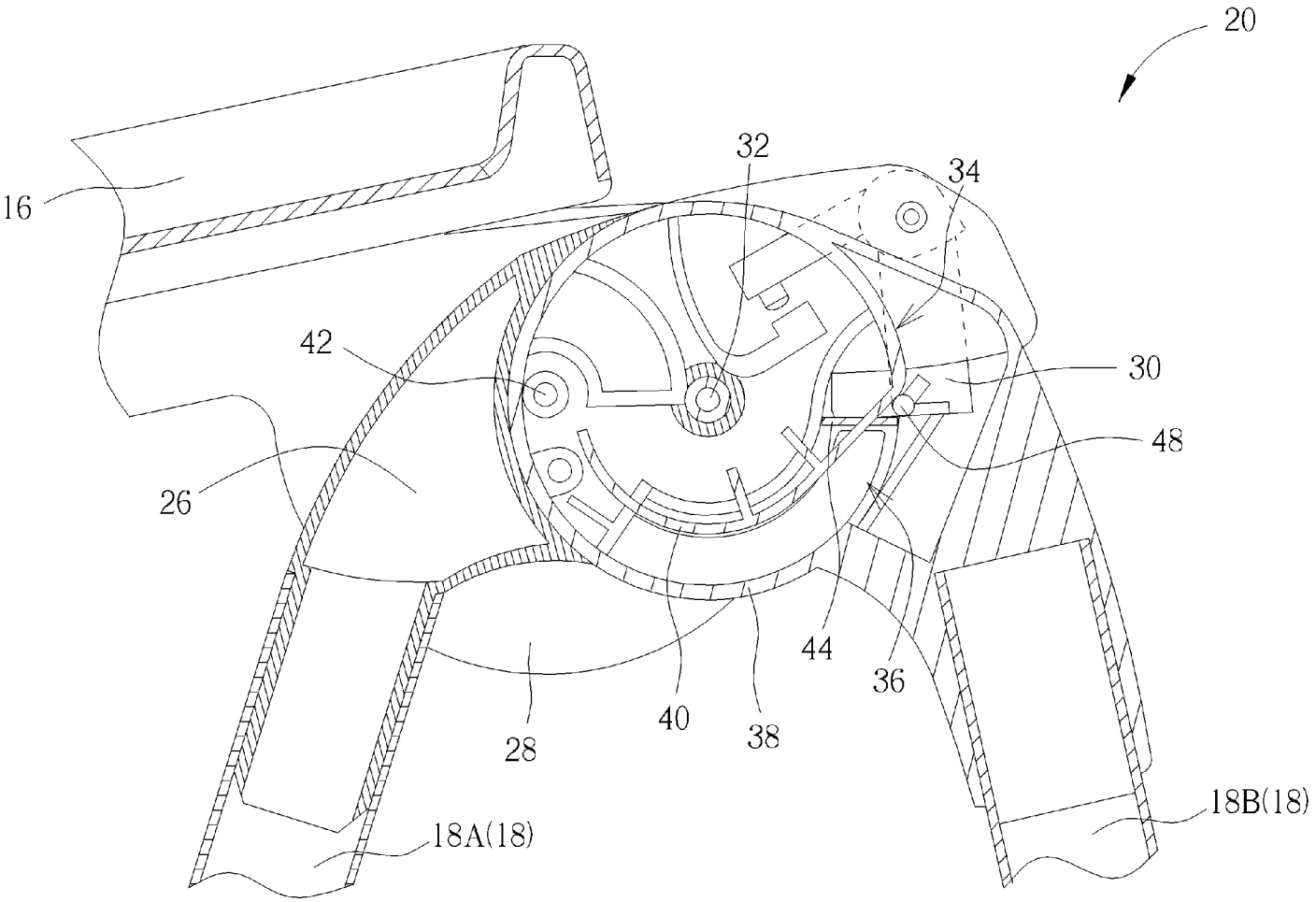
Figure 6:
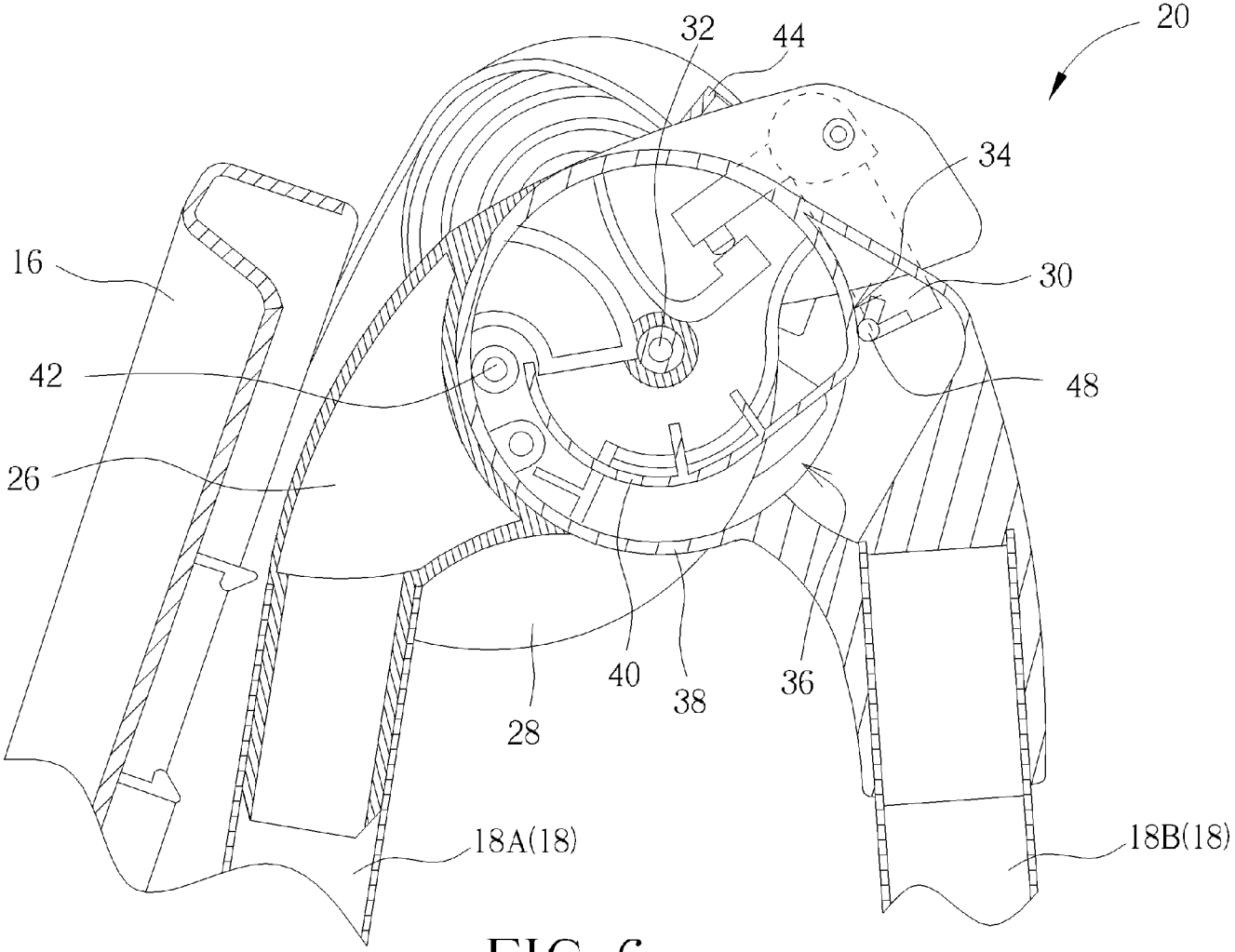

Please refer to FIG. 4 to FIG. 6. FIG. 4 to FIG. 6 respectively are sectional views of the joint mechanism 20 indifferent operational modes according to the embodiment of the present invention. The joint mechanism 20 includes a first leg 24, a second leg 26, an extension arm 28 and a latching component 30. The first leg 24 and the second leg 26 are respectively disposed on the two sets of leg tube 18. The first leg 24 is pivotally connected to the second leg 26 via a central pivot 32, and the second leg 26 can rotate relative to the first leg 24 to switch between a folded position (which is shown in FIG. 6) and an unfolded position (which is shown in FIG. 4). The first leg 24 which includes a cammed portion 34 and an accommodating space 36 can be mainly composed of an arc-shaped structure 38 and a extension structure 40. The extension structure 40 is connected to an end of the arc-shaped structure 38 and stretches out into an opening of the arc-shaped structure 38. The opening is a breach of the uncompleted annularity and equals the accommodating space 36. The cammed portion 34 is an outer surface of the arc-shaped structure 38 adjacent by the accommodating space 36.

Figure 7:
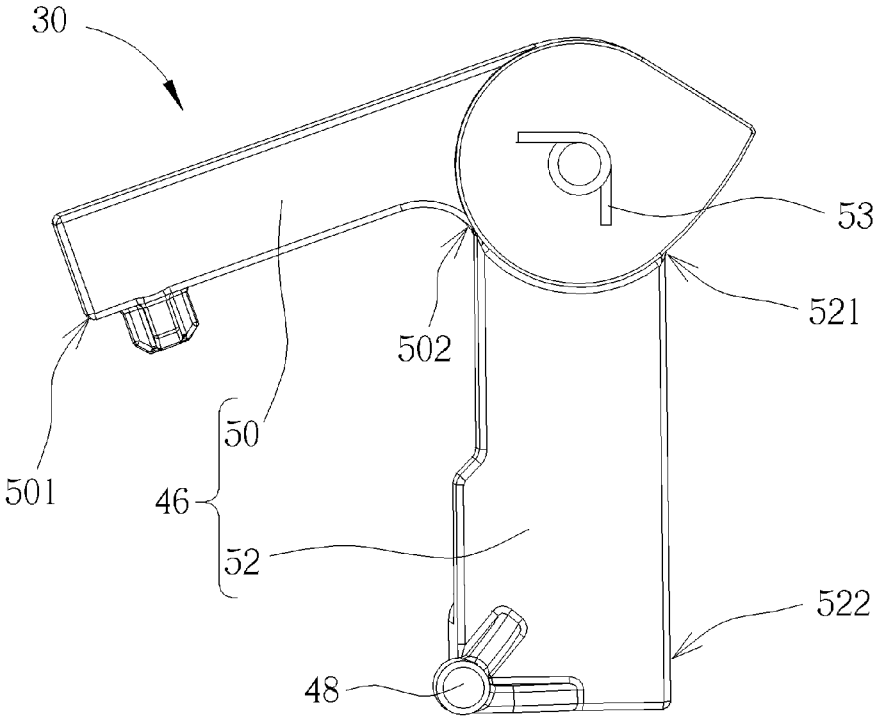
FIG. 7 and FIG. 8 respectively are diagrams of a latching component according to different embodiments of the present invention.
Figure 8:
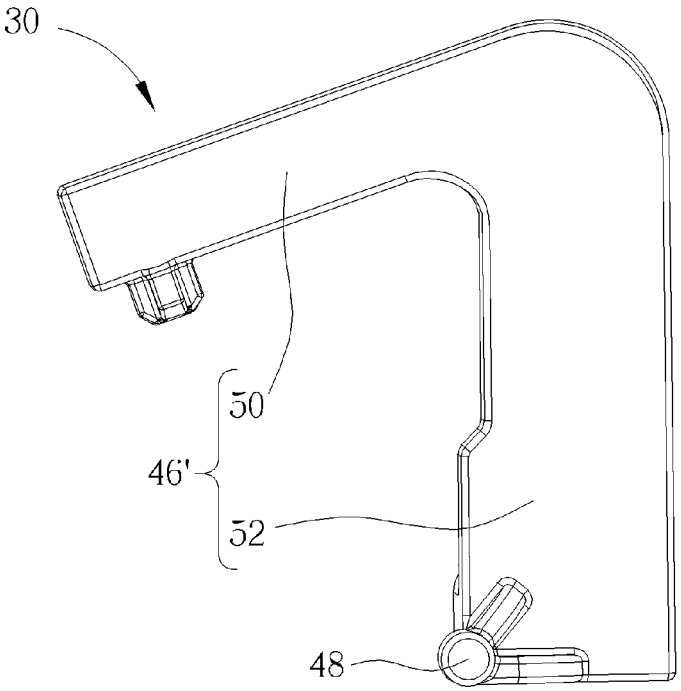

The tray 16 can be disposed on the extension arm 28, and the extension arm 28 is pivotally connected to the second leg 26 via a tray axis 42. The latching component 30 is movably disposed on the second leg 26 to contact against a restricted portion 44 of the extension arm 28 so as to constrain rotation of the tray 16. Please refer to FIG. 7 and FIG. 8. FIG. 7 and FIG. 8 respectively are diagrams of the latching component 30 according to different embodiments of the present invention. The latching component 30 includes a main body 46 and a protrusion 48. The main body 46 is disposed on the second leg 26, the protrusion 48 is disposed on a part of the main body 46 opposite to the second leg 26, and the protrusion 48 is utilized to contact against or separate from the restricted portion 44 to lock and unlock rotation between the extension arm 28 and the second leg 26. In the embodiment shown in FIG. 7, the main body 46 includes a first part 50 and a second part 52. An end 502 of the first part 50 is pivotally connected to the second leg 26, an end 521 of the second part 52 is connected to the end 502 of the first part 50, the protrusion 48 is disposed on the other end 522 of the second part 52, and a resilient component 53 is selectively disposed between the end 502 and the end 521. The resilient component 53 can be a torsional spring. The resilient component 53 is deformed while the second part 52 is unfolded relative to the first part 50, which means an angle formed between the second part 52 and the first part 50 is enlarged, and a resilient recovering force of the resilient component 53 is generated and stored accordingly. In addition, the other end 501 of the first part 50 can include a protruding structure, and the protruding structure can abut against the second leg 26 as in the folded position. When an external force that drives the second part 52 and the first part 50 to unfold is removed, the resilient recovering force of the resilient component 53 can be released to fold the second part 52 relative to the first part 50, and the angle formed between the second part 52 and the first part 50 is reduced accordingly. That is, position of the protrusion 48 can be automatically recovered by the resilient component 53.

In the embodiment shown in FIG. 8, the latching component 30 may include the main body 46' and the main body 46' is an integrated crooked rod without resilient property; however, the main body 46' may be deformable optionally. An end of the main body 46' is fixed to the second leg 26, and the other end of the main body 46' is a free end whereon the protrusion 48 is disposed. The protrusion 48 has an initial position that is located inside the accommodating space 36 while the latching component 30 is assembled with the second leg 26. The protrusion 48 of the main body 46' is locate inside the accommodating space 36 to contact against the restricted portion 44 while the protrusion 48 moves from the cammed portion 34 to the accommodating space 36 and the first leg 24 and the second leg 26 are unfolded, as shown in FIG. 4, so that the extension arm 28 cannot rotate relative to the second leg 26 and rotation of the tray 16 is constrained. When the first leg 24 and the second leg 26 are folded, the protrusion 48 of the main body 46' is removed from the accommodating space 36 to disconnect from the restricted portion 44 and further to move upon the cammed portion 34, as shown in FIG. 6, the extension arm 28 is freely rotated relative to the second leg 26 and the tray 16 can be folded to be substantially parallel to the leg tube 18 accommodating space.

In FIG. 4, the second leg 26 is unfolded relative to the first leg 24, the restricted portion 44 of the extension arm 28 aligns with the accommodating space 36 of the first leg 24, and the latching component 30 connected to the second leg 26 can contact against the restricted portion 44 by the protrusion 48 to constrain the relative rotation between the extension arm 28 and the second leg 26, so the tray 16 can be supported at an useful position shown in FIG. 1 and FIG. 2. As the second leg 26 rotates relative to the first leg 24 via the central pivot 32, as shown in FIG. 5, the latching component 30 is accordingly moved due to rotation of the second leg 26, the protrusion 48 which is suspended in the accommodating space 36 can contact and slide over the extension structure 40, and is removed from the accommodating space 36 to climb upon the cammed portion 34. In the meantime, the resilient component 53 or the main body 46' is compressed to store the resilient recovering force. While the second leg 26 is folded relative to the first leg 24, as shown in FIG. 6, the protrusion 48 climbs out over the cammed portion 34, which means the protrusion 48 is not located inside the accommodating space 36 and cannot block the restricted portion 44, so that the extension arm 28 can be freely rotated relative to the second leg 26 and the tray 16 is automatically adjusted to be substantially parallel to the second leg 26 (as shown in FIG. 3) to minimize the size of the child high chair 10.

For unfolding the child high chair 10 from the mode shown in FIG. 6 to the mode shown in FIG. 4, the second leg 26 is rotated at a clockwise direction or the first leg 24 is rotated at a counterclockwise direction, position of the latching component 30 is varied due to the relative rotation of the first leg 24 and the second leg 26, the protrusion 48 moves from the cammed portion 34 to the accommodating space 36, and the resilient recovering force of the resilient component 53 or the main body 46' drives the protrusion 48 to sink into the accommodating space 36. Then, the tray 16 and the related extension arm 28 are rotated at the clockwise direction. The protrusion 48 can be engaged with the restricted portion 44 while the restricted portion 44 aligns with the accommodating space 36, and the tray 16 can be stably set on the useful position shown in FIG. 1 and FIG. 2.

Figure 10:
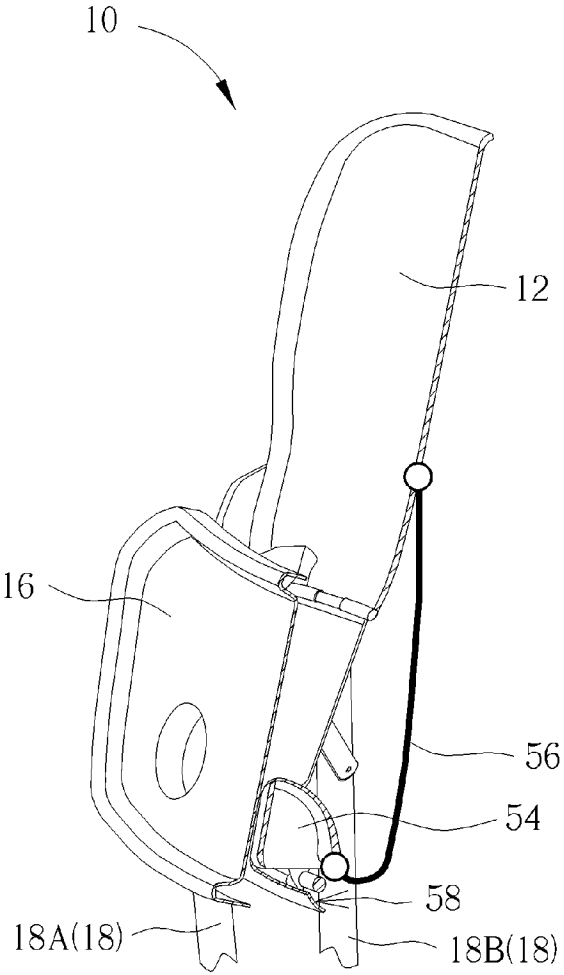
FIG. 9 and FIG. 10 respectively are sectional views of the child high chair in different operational modes according to the embodiment of the present invention.
Figure 9:
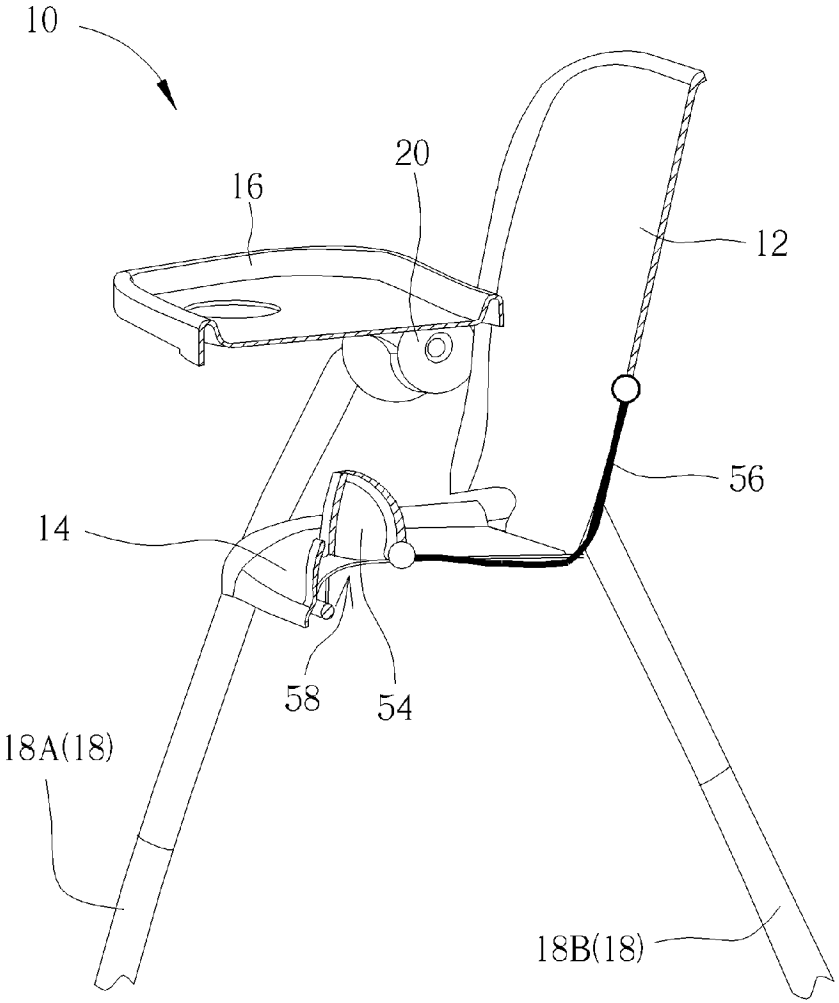

Please refer to FIG. 9 and FIG. 10. FIG. 9 and FIG. 10 respectively are sectional views of the child high chair 10 indifferent operational modes according to the embodiment of the present invention. The child high chair 10 further includes a horn 54 and a flexible connector 56. The horn 54 is rotatably disposed on the seat pan 14 and adjacent by a protruding hole 58 formed on the seat pan 14, and two ends of the flexible connector 56 are respectively connected to the seatback 14 and the horn 54. The flexible connector 56 can be, but not limited to, made of nylon webbing. As shown in FIG. 9, while the first leg 24 and the second leg 26 are unfolded, an angle between the seatback 12 and the seat pan 14 may be substantially greater than or equal to ninety degrees to let the child stably sit, and an angle between the seatback 12 and the tray 16 may be substantially equal to ninety degrees to place the food or the toy. The flexible connector 56 is stretched out by unfolding of the seatback 12 and the seat pan 14, and a resilient recovering force of the flexible connector 56 rotates the horn 54 relative to the seat pan 14 to protrude from an upper surface of the seat pan 14 via the protruding hole 58. The horn 54 can prevent the child from falling down the seat pan 14.

The foresaid angles formed between the seatback 12 and the seat pan 14 and between the seatback 12 and the tray 16 are not limited to the above-mentioned embodiment, which depends on actual demand, and a detailed description is omitted herein for simplicity.

As shown in FIG. 10, the first leg 24 and the second leg 26 are folded to rotate the seat pan 14 to be substantially parallel to the seatback 12. In the meantime, the protrusion 48 is removed from the accommodating space 36 to release constraint of the joint mechanism 20 (which is illustrated in FIG. 4 to FIG. 6), so the tray 16 can be rotated by its weight or external force to be substantially parallel to the seat pan 14. The flexible connector 56 is loosened and cannot pull the horn 54, so the horn 54 can be pressed by the tray 16 to move into the protruding hole 58, or the horn 54 can be retracted into the protruding hole 58 due to the gravity. It is to say, the horn 54 can be automatically accommodated under the seat pan 14 through the protruding hole 58 while the two sets of leg tube 18 and the tray 16 are folded, so as to effectively minimize the size of the child high chair 10.

Figure 11:
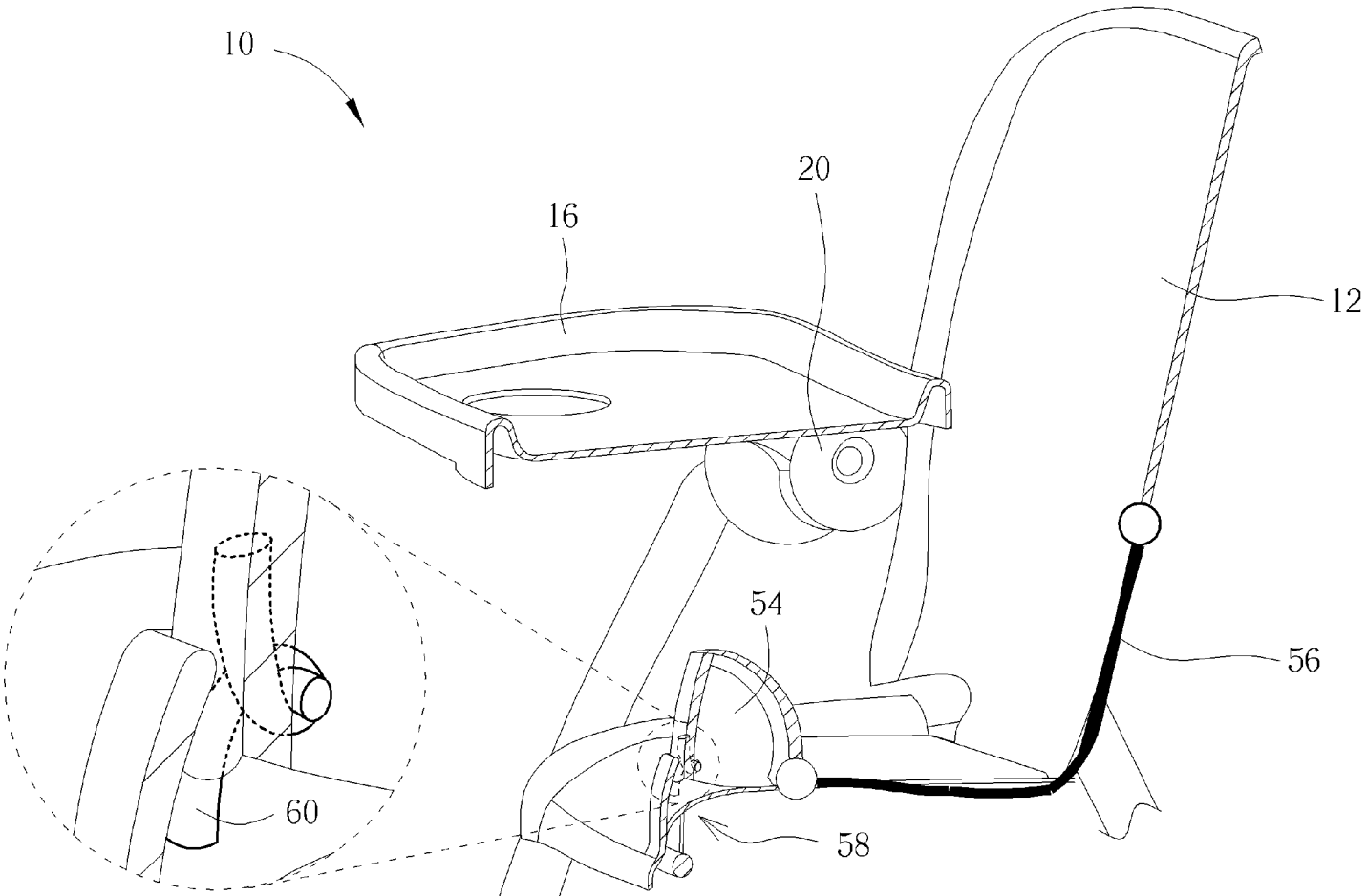
FIG. 11 is a diagram of the child high chair according to another embodiment of the present invention.

Please refer to FIG. 11. FIG. 11 is a diagram of the child high chair 10 according to another embodiment of the present invention. In this embodiment, elements having the same numeral as ones of the above-mentioned embodiment have the same functions and structure. The child high chair 10 further can include a torsional resilient unit 60 disposed between the horn 54 and the seat pan 14. A resilient recovering force of the torsional resilient unit 60 is preferably smaller than a resilient recovering force of the flexible connector 56. While the first leg 24 and the second leg 26 (which represents the two sets of leg tube 18) are folded and the flexible connector 56 is loosened, the resilient recovering force of the torsional resilient unit 60 can rotate the horn 54 into the protruding hole 58 automatically to prevent the folded tray 16 and the horn 54 from structural interference.

In conclusion, the child high chair of the present invention can automatically retract the tray and the horn while folded. The second leg is folded relative to the first leg to rotate the latching component and to loosen the flexible connector, and the protrusion of the latching component can slide over the extension structure to move from the extension structure to the cammed portion, so the extension arm is not constrained by the protrusion and the tray can freely rotate relative to the second leg for retraction, and the horn can be pressed into the protruding hole by the tray, the gravity or the torsional resilient unit. In addition, the second leg is unfolded relative to the first leg to move the protrusion from the cammed portion to the accommodating space, the resilient recovering force of the main body or the resilient component drives the protrusion to sink into the accommodating space, and the flexible connector is lengthened to protrude the horn out of the protruding hole, so the protrusion can be utilized to constrain rotation of the extension arm when the tray is rotated to the useful position and the horn can prevent the child from sliding out of the seat pan. Comparing to the prior art, the child high chair can automatically retract the tray and the horn while folded and further stabilize the tray and the horn at the useful position while unfolded. The child high chair of the present invention maintains current standards for safety and comfort, and also provides an easy to fold, compact storage solution that improves overall convenience.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A joint mechanism for a child high chair, the joint mechanism comprising:

a first leg, comprising an accommodating space;

a second leg pivotally connected to the first leg via a central pivot, the second leg being adapted to rotate relative to the first leg to switch between a folded position and an unfolded position;

an extension arm pivotally connected to the second leg via a tray axis different from the central pivot, the extension arm comprising a restricted portion; and a latching component movably disposed on the second leg, the latching component being adapted to accommodate in the accommodating space and adapted to contact against the first leg and the restricted portion of the extension arm while the second leg is adapted to switch to the unfolded position, the latching component being adapted to remove from the accommodating space and disconnect from the restricted portion of the extension arm while the second leg is adapted to switch to the folded position.

2. The joint mechanism of claim 1, wherein the first leg further comprises a cammed portion adjacent to the accommodating space, and the latching component comprises:

a main body disposed on the second leg; and a protrusion disposed on a part of the main body opposite to the second leg, the protrusion being adapted to locate inside the accommodating space to contact against the restricted portion while the second leg is adapted to switch to the unfolded position, the protrusion being adapted to move upon the cammed portion to separate from the restricted portion while the second leg is adapted to switch to the folded position.

3. The joint mechanism of claim 2, wherein the main body is made of resilient material, and a resilient recovering force of the main body is adapted to drive the protrusion to sink into the accommodating space while the protrusion moves from the cammed portion to the accommodating space.

4. The joint mechanism of claim 2, wherein the main body comprises a first part and a second part, an end of the first part is pivotally connected to the second leg, an end of the second part is connected to the end of the first part, and the protrusion is disposed on the other end of the second part.

5. The joint mechanism of claim 2, wherein the protrusion contacts against the restricted portion to constrain relative rotation between the extension arm and the second leg, and the extension arm is freely rotated relative to the second leg while the protrusion is separated from the restricted portion.

6. The joint mechanism of claim 2, wherein the first leg further comprises an arc-shaped structure and an extension structure, an opening of the arc-shaped structure faces toward the accommodating space, the cammed portion is an outer surface of the arc-shaped structure, and the extension structure is connected to an end of the arc-shaped structure and stretches out into the opening, wherein the second leg is adapted to fold relative to the first leg to slide the protrusion over the extension structure and the protrusion is moved from the extension structure to the cammed portion, the second leg is adapted to unfold relative to the first leg to move the protrusion from the cammed portion into the accommodating space.

7. A child high chair, comprising:

a seatback;

a seat pan rotatably connected to the seatback;

a tray;

two sets of leg tube; and a joint mechanism, comprising:

a first leg disposed on one of the two sets of leg tube and comprising an accommodating space;

a second leg pivotally connected to the first leg via a central pivot and disposed on the other set of leg tube, the second leg being adapted to rotate relative to the first leg to switch between a folded position and an unfolded position;

an extension arm whereon the tray is disposed pivotally connected to the second leg via a tray axis different from the central pivot, the extension arm comprising a restricted portion; and a latching component movably disposed on the second leg, the latching component being adapted to accommodate in the accommodating space and adapted to contact against the first leg and the restricted portion of the extension arm while the second leg is adapted to switch to the unfolded position, the latching component being adapted to remove from the accommodating space and disconnect from the restricted portion of the extension arm while the second leg is adapted to switch to the folded position.

8. The child high chair of claim 7, wherein the first leg further comprises a cammed portion adjacent to the accommodating space, and the latching component comprises:

a main body disposed on the second leg; and a protrusion disposed on a part of the main body opposite to the second leg, the protrusion being adapted to locate inside the accommodating space to contact against the restricted portion while the second leg is adapted to switch to the unfolded position, the protrusion being adapted to move upon the cammed portion to separate from the restricted portion while the second leg is adapted to switch to the folded position.

9. The child high chair of claim 8, wherein the main body is made of resilient material, and a resilient recovering force of the main body is adapted to drive the protrusion to sink into the accommodating space while the protrusion moves from the cammed portion to the accommodating space.

10. The child high chair of claim 8, wherein the main body is made of non-resilient material.

11. The child high chair of claim 8, wherein the main body comprises a first part and a second part, an end of the first part is pivotally connected to the second leg, an end of the second part is connected to the end of the first part via a resilient component, and the protrusion is disposed on the other end of the second part.

12. The child high chair of claim 8, wherein the protrusion contacts against the restricted portion to constrain relative rotation between the extension arm and the second leg, and the extension arm is freely rotated relative to the second leg while the protrusion is separated from the restricted portion.

13. The child high chair of claim 8, wherein the first leg further comprises an arc-shaped structure and an extension structure, the accommodating space is an opening of the arc-shaped structure, the cammed portion is an outer surface of the arc-shaped structure, and the extension structure is connected to an end of the arc-shaped structure and stretches out into the opening.

14. The child high chair of claim 13, wherein the second leg is adapted to fold relative to the first leg to slide the protrusion over the extension structure and the protrusion is adapted to move from the extension structure to the cammed portion, the second leg is adapted to unfold relative to the first leg to move the protrusion from the cammed portion into the accommodating space.

15. The child high chair of claim 7, wherein an angle between the seatback and the seat pan is greater than or equal to ninety degrees while the first leg and the second leg are unfolded, the seat pan is parallel to the seatback while the first leg and the second leg are folded.

16. The child high chair of claim 7, wherein a protruding hole is formed on the seat pan, and the child high chair further comprises a horn, the horn is rotatably disposed on the seat pan and adjacent to the protruding hole.

17. The child high chair of claim 16, wherein the child high chair further comprises a flexible connector, an end of the flexible connector is connected to the horn, and the other end of the flexible connector is connected to the seatback, the seat pan, the tray or the two sets of leg tube.

18. The child high chair of claim 17, wherein a resilient recovering force of the flexible connector is adapted to drive the horn to rotate relative to the seat pan and to protrude from an upper surface of the seat pan via the protruding hole.

19. The child high chair of claim 16, wherein the tray presses the horn into the protruding hole or the horn is retracted into the protruding hole while the first leg and the second leg are folded.

20. The child high chair of claim 16, further comprising:

a torsional resilient unit disposed between the horn and the seat pan, a resilient recovering force of the torsional resilient unit being adapted to rotate the horn into the protruding hole.

* * * * *